US006845883B2

(12) United States Patent
Pieri

(10) Patent No.: US 6,845,883 B2
(45) Date of Patent: Jan. 25, 2005

(54) TOOTHPASTE DISPENSER

(76) Inventor: Kenneth H. Pieri, 111 Porter Ave. Suite 266, Buffalo, NY (US) 14201

( * ) Notice: Subject to any disclaimer, the term of this patent is extended or adjusted under 35 U.S.C. 154(b) by 267 days.

(21) Appl. No.: 10/272,331

(22) Filed: Oct. 16, 2002

(65) Prior Publication Data

US 2003/0075561 A1 Apr. 24, 2003

Related U.S. Application Data

(60) Provisional application No. 60/329,855, filed on Oct. 18, 2001.

(51) Int. Cl.[7] ..... B65D 35/22
(52) U.S. Cl. ..... 222/94; 222/541.6
(58) Field of Search ..... 222/94, 23, 541.6; 242/160.1, 160.4, 588.3, 588.6

(56) References Cited

U.S. PATENT DOCUMENTS

| | | | | |
|---|---|---|---|---|
| 3,126,129 A | * | 3/1964 | Weinberg | 222/94 |
| 3,189,227 A | * | 6/1965 | Hobbs et al. | 222/94 |
| 3,324,995 A | | 6/1967 | Sharp, Jr. | |
| 3,381,808 A | | 5/1968 | McGraw, II | |
| 3,397,671 A | | 8/1968 | Hartman, Jr. et al. | |
| 3,405,797 A | * | 10/1968 | Dwyer, Jr. | 206/395 |
| 4,090,642 A | * | 5/1978 | Baker | 222/94 |
| 4,364,474 A | | 12/1982 | Hollander, Jr. | |
| 6,260,735 B1 | | 7/2001 | Fuquen | |
| 6,345,733 B1 | | 2/2002 | Bennett | |

FOREIGN PATENT DOCUMENTS

| | | |
|---|---|---|
| DE | 4238421 A1 | 5/1994 |
| FR | 2560521 A1 | 9/1985 |
| FR | 2644141 A1 | 9/1990 |
| WO | WO 02/26078 A2 | 4/2002 |

* cited by examiner

*Primary Examiner*—Gene Mancene
*Assistant Examiner*—Melvin Cartagena
(74) *Attorney, Agent, or Firm*—John C. Thompson

(57) ABSTRACT

A toothpaste dispenser capable of dispensing individual quantity controlled amounts of toothpaste in a sanitary manner without the possibility of cross contamination. The dispenser includes an elongated strip having a plurality of one time use sachets formed integrally therewith, each sachet containing a measured quantity of toothpaste therein suitable for a single use. The strip is provided with weakened portions so that individually numbered sachets may detached from the strip. The individual sachets may be opened after they are detached from the strip and the contents may be squeezed out. In addition, the sachets may be color coded which is useful when the usage of more than one child is being monitored. A parent may monitor the usage of the individual sachets by reviewing the number, and if more than one child is in the family, the color of the emptied sachet.

8 Claims, 4 Drawing Sheets

TOOTHPASTE DISPENSER

CROSS-REFERENCE TO RELATED APPLICATIONS

This application claims the benefit under 35 U.S.C. §119 (e) of U.S. provisional patent application Ser. No. 60/329,855 filed Oct. 18, 2001.

TECHNICAL FIELD

The present invention relates to a dispenser for individual quantity controlled amounts of toothpaste, and more particularly to an array of individual dispensers of quantity controlled amounts of toothpaste so that usage by each child in a family or household can be encouraged and monitored.

BACKGROUND OF THE INVENTION

It is well known in the art to provide sample or individual packets of toothpaste and products of similar consistency, which packets are frequently called sachets. Typical examples are shown in U.S. Pat. No. 6,260,735, U.S. Pat. No. 6,345,733, and FR 2644141. These sachets may have a single compartment, as shown in FIG. 1 of FR 2644141, or may be a dual compartment as shown in U.S. Pat. Nos. 6,260,735 and 6,345,733 and FIG. 3 of FR 2644141. The purpose of the dual compartment is to hold different forms of toothpaste until they are to be mixed, for example a toothpaste component including sodium bicarbonate, and another tooth paste component containing hydrogen peroxide. In these various designs disclosed above, the toothpaste is used by squeezing the container to expel the toothpaste.

Other forms of individual packaging are known. In recently published WO 02/26078 a free flow toothpaste composition is provided in the form of a plurality of beads, each bead containing about enough toothpaste for an average cleaning procedure. The beads are dissolved in the mouth and then the toothpaste is brushed onto the teeth. It is pointed out in this publication that the dental health of children is under threat, especially with the availability of sweetened drinks and snack foods. It is a stated advantage of this invention that there is no residue, and therefore is environmentally friendly. However, with the design shown in the recent publication, parents have no way of knowing if their children have availed themselves of these toothpaste beads as they are not numbered, and as there is no residue after use.

A further form of toothpaste packaging for individual use is shown in DE 42 38 421. This publication discloses that a portion of toothpaste may be enclosed in a capsule which may be opened by chewing or by dissolving in the mouth. The complete capsules may be sold in a set of blister packs, which are individually numbered. The individual packs are separated from one another by perforated lines. In this design the toothpaste is not squeezed from the individual packets, but are chewed. Therefore, there is no residual evidence of use for a parent of a child to inspect to see if in fact the child has used the toothpaste for a particular day.

It is also known to have pills in blister packs which have daily use indicia on the package, as for example in U.S. Pat. Nos. 3,324,995, 3,381,808, and 3,397,671. However, after the pills have been taken from the packaging there is no residual evidence that the pill has actually been taken. Thus the daily pill is entirely consumed, whereas in the design of this application, after the single use of toothpaste has been squeezed from its single use sachet, there remains an empty numbered sachet.

OBJECTS AND SUMMARY OF THE INVENTION

It is an object of the present invention to provide a way that the parents of a child can follow-up to see if their child has actually brushed their teeth.

More particularly, it is an object of the present invention to provide packaging for toothpaste wherein an exact measured quantity of tooth paste suitable for a one time use is packaged in a squeezable sachet, which sachet is attached to other sachets, the various sachets bearing indicia indicative of daily usage.

It is also an object of the present invention to provide a toothpaste dispenser which avoids cross-contamination of germs, thereby teaching children good hygiene.

The preceding objects and other objects and advantages of this invention will be more fully understood after a consideration of the following detailed description is taken in conjunction with the accompanying drawings in which preferred forms of this invention are illustrated.

DETAILED DESCRIPTION

Figure 1:
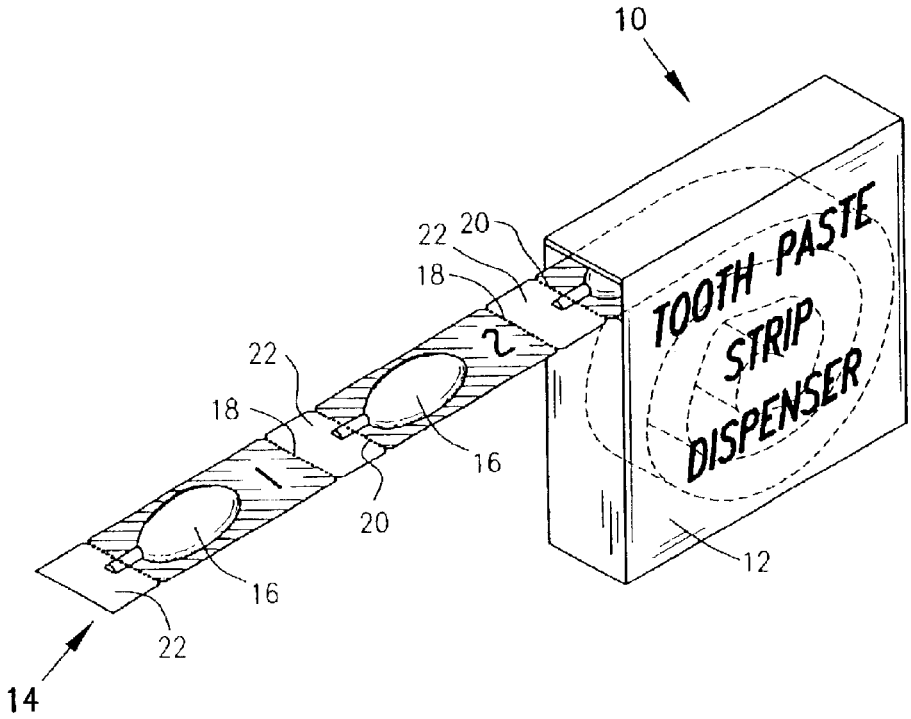
FIG. 1 illustrates a toothpaste dispenser of this invention, the dispenser including a container which contains an elongated strip provided with a plurality of individual sachets or packets of toothpaste.

With reference initially to FIG. 1, a toothpaste dispenser is indicated generally at 10, the dispenser including a container 12, and an elongated strip indicated generally at 14, which strip 14 is coiled within the container 12. The strip can be formed in differing manners, depending upon the packaging machinery available. In one form the strip may be formed from a tube of suitable material, which tube receives measured quantities of toothpaste which are formed into individual sachets 16 by heat sealing the tube, or by ultrasonicly welding the tube, or by any other suitable manner, the individual sachets 16 being separated from each other by spaced apart weakened portions 18.

The strip is printed with indicia, such as numbers representing days of the month. In use, the sachets are separated one from the other by tearing along the weakened portions 18. Furthermore, each sachet is provided with means for opening the sachet so that toothpaste may be squeezed from the sachet. In the illustrated embodiment, this is accomplished by providing a further weakened portion 20. While a weakened portion in the form of a tear strip is illustrated, other designs may be utilized which are well known in the art. For example, a frangible portion may be provided which may be opened by folding tab 22. Alternatively, the means for opening may be a weakened film portion in the blister which surrounds the toothpaste. As such designs are well known in the art they will not be described further.

Figure 6:
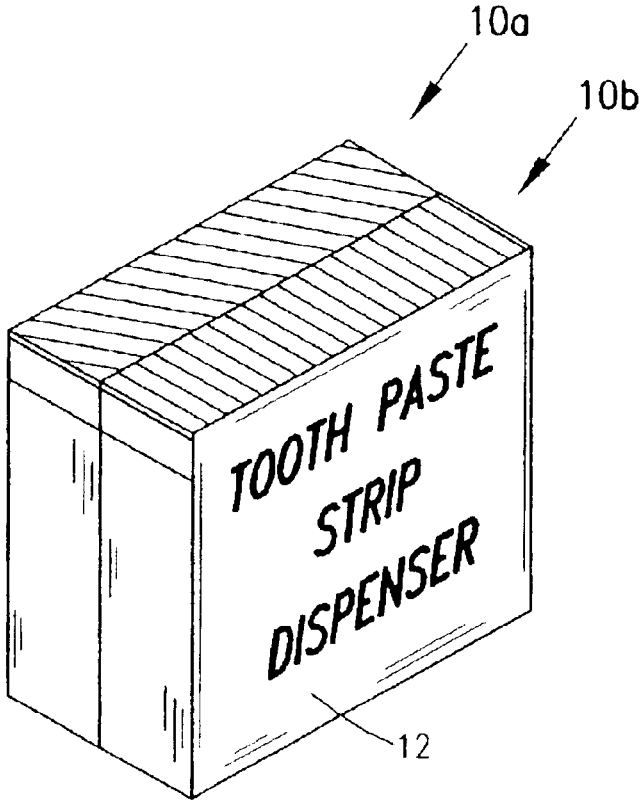
FIG. 6 illustrates how two dispensers may be sold to a consumer having two children.

In addition to having numbered indicia corresponding to each day of the month, the sachets may also be provided with colors corresponding to each container 12, a different colored container being selected for each child. Thus, for example, as shown in FIG. 6, two different colored containers are shown.

Figure 2:
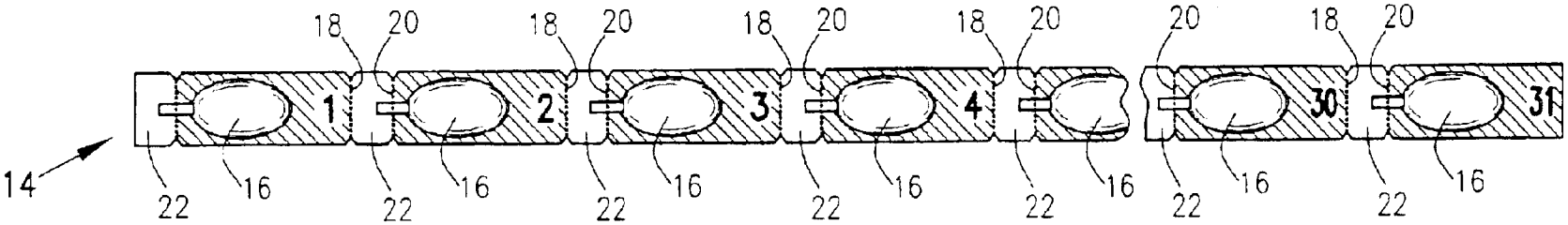
FIG. 2 illustrates a strip of individual sachets of toothpaste.
Figure 3:
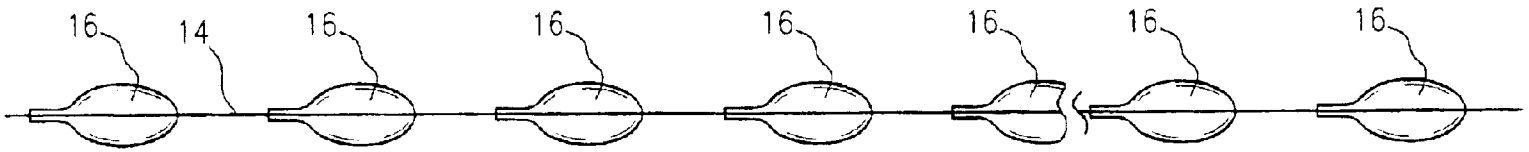
FIG. 3 is a side view of the strip shown in FIG. 2.
Figure 5:
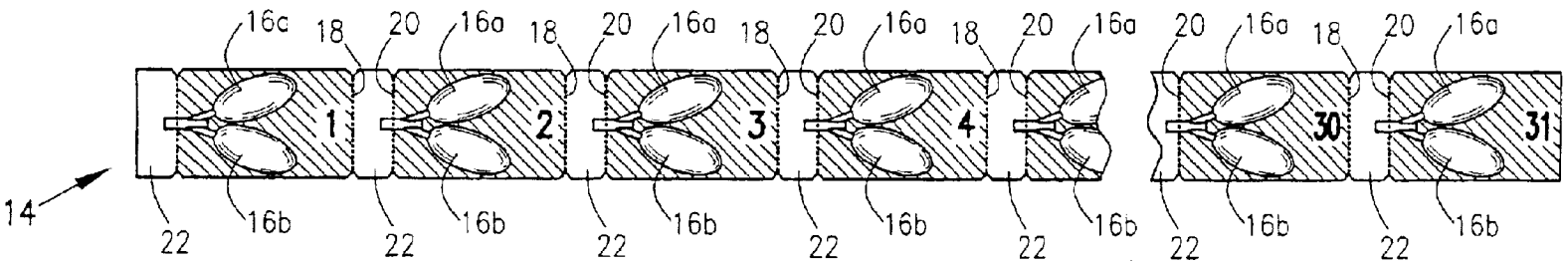
FIG. 5 illustrates an alternative sachet design where two differing toothpaste components are carried in a single sachet.

While a single quantity of toothpaste is provided in each sachet shown in FIGS. 1–3, many toothpastes today utilize differing components which are mixed only upon use. Thus, if a toothpaste includes hydrogen peroxide and a baking soda, these components should not be mixed until they are to be applied to the teeth. Therefore, the sachets may include two blisters 16*a* and 16*b* for the differing components as shown in FIG. 5. While two side-by-side blisters 16*a* and 16*b* are illustrated, they may also be on top of one another as shown in U.S. Pat. No. 6,260735, or separated from one another by a transverse fracture line as shown in FIG. 3 of FR 2644141.

By utilizing the present invention, a parent can determine if a child has used the toothpaste for a given day as it is only necessary to see if the numbered sachet has been emptied and matching the designated color for the particular child. Thus, as frequently there is more than one child in a household, the parent may wish to buy differing color coded containers which contains the same color matching sachet and tape. Two different color coded containers 10*a* and 10*b* are shown in FIG. 6. Of course, more than two color coded containers could be sold to consumers.

Figure 4:
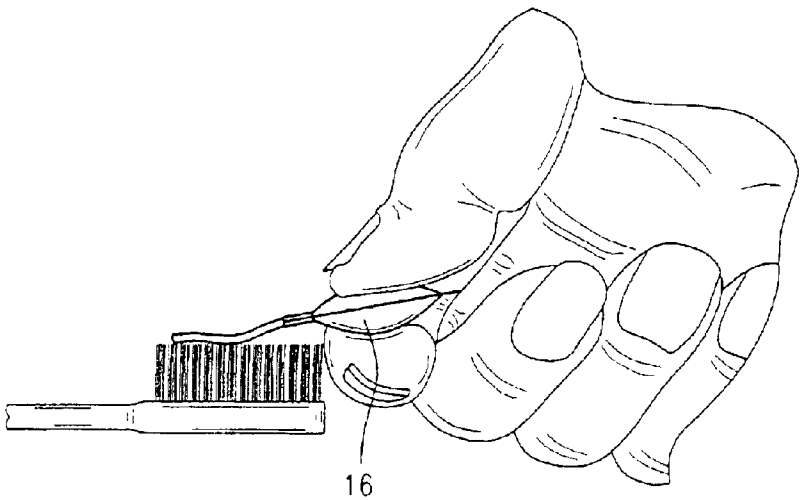
FIG. 4 illustrates the manner of using an individual sachet of toothpaste.

Of course a clever child could empty the sachet without brushing their teeth, but as it would be time consuming and devious to hide the toothpaste if not used, it is presumed that most children would simply brush their teeth by emptying the sachet onto their toothbrush as shown in FIG. 4.

While the present invention has been described for a single brushing once a day, it should be obvious that other frequencies could be designed into the subject matter of the present invention. Thus, there could be 62 sachets in a coil, there being two for each day, one being marked AM and the other PM.

Finally, while the particular invention has application in monitoring a child's brushing habits, it is quite possible that a parent may buy a coil of the sachets for themselves, as when traveling. The individual sachets have advantages over conventional toothpaste tubes in that cross-contamination is prevented as only one toothbrush will come into contact with the toothpaste in each sachet, as compared with today's common use of a single tube of toothpaste which comes into contact with more than one toothbrush.

While preferred forms of this invention have been described above and shown in the accompanying drawings, it should be understood that applicant does not intend to be limited to the particular details described above and illustrated in the accompanying drawings, but intends to be limited only to the scope of the invention as defined by the following claims. In this regard, the term "means for" as used in the claims is intended to include not only the designs illustrated in the drawings of this application and the equivalent designs discussed in the text, but it is also intended to cover other equivalents now known to those skilled in the art, or those equivalents which may become known to those skilled in the art in the future.

What is claimed is:

1. A toothpaste dispenser useful to monitor a young child's frequency of brushing their teeth; said toothpaste dispenser comprising:

an elongated strip provided with a plurality of spaced apart weakened portions to facilitate the tearing of the strip;

a plurality of individual sachets; each sachet being formed on the strip between adjacent spaced apart weakened portions, individual sachets being filled with a quantity controlled amount of toothpaste, and each sachet further including means for opening the sachet so that the toothpaste may be squeezed from the sachet; and indicia on the strip between adjacent spaced apart weakened portions, one indicia being adjacent each sachet, the indicia representing different days of the month so that the usage of the cachets can be monitored after use.

2. The toothpaste dispenser as set forth in claim 1 wherein the means for opening the sachet is a tear strip.

3. The toothpaste dispenser as set forth in claim 1 wherein the indicia are numbers from 1 to 31.

4. The toothpaste dispenser set forth in claim 1 wherein the indicia include colors.

5. The toothpaste dispenser set forth in claim 1 wherein the strip including a web and the individual sachets are blisters formed on the web.

6. The toothpaste dispenser as set forth in claim 5 wherein each sachet has two or more chambers containing differing components of the toothpaste which should not be mixed until use.

7. The toothpaste dispenser as set forth in claim 1 wherein the strip is coiled, and further including a dispensing container which bears indicia.

8. Toothpaste dispensers useful to monitor children's frequency of brushing their teeth; said toothpaste dispensers comprising:

two or more containers, differing containers bearing differing indicia so that each container can be identified with a particular child;

an elongated strip in each container, each strip being provided with spaced apart weakened portions to facilitate the tearing of the strip;

a plurality of individual sachets, each sachet being carried by the strip between the spaced apart weakened portions, individual sachets being filled with a quantity controlled amount of toothpaste, and each sachet further including means for opening the sachet so that the toothpaste may be squeezed from the sachet; and indicia on the strip, one indicia adjacent each sachet, the indicia being different so that the usage of the cachets can be monitored.

* * * * *